US011100846B2

(12) United States Patent
Xuan et al.

(10) Patent No.: US 11,100,846 B2
(45) Date of Patent: Aug. 24, 2021

(54) DISPLAY-DRIVING CIRCUIT FOR MULTI-ROW PIXELS IN A SINGLE COLUMN, A DISPLAY APPARATUS, AND A DISPLAY METHOD

(71) Applicant: BOE Technology Group Co., Ltd., Beijing (CN)

(72) Inventors: Minghua Xuan, Beijing (CN); Li Xiao, Beijing (CN); Lei Wang, Beijing (CN); Xiaochuan Chen, Beijing (CN); Detao Zhao, Beijing (CN); Dongni Liu, Beijing (CN); Liang Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 15 days.

(21) Appl. No.: 16/638,427

(22) PCT Filed: Nov. 22, 2018

(86) PCT No.: PCT/CN2018/116946
§ 371 (c)(1),
(2) Date: Feb. 11, 2020

(87) PCT Pub. No.: WO2020/103083
PCT Pub. Date: May 28, 2020

(65) Prior Publication Data
US 2021/0217352 A1 Jul. 15, 2021

(51) Int. Cl.
*G09G 3/32* (2016.01)

(52) U.S. Cl.
CPC ..... *G09G 3/32* (2013.01); *G09G 2310/08* (2013.01); *G09G 2320/045* (2013.01)

(58) Field of Classification Search
CPC . G09G 3/32; G09G 2310/08; G09G 2320/045
See application file for complete search history.

(56) References Cited

U.S. PATENT DOCUMENTS

2005/0104817 A1* 5/2005 Kwak ..... G09G 3/2022 345/76
2014/0022150 A1 1/2014 Guo et al.
(Continued)

FOREIGN PATENT DOCUMENTS

CN 104167170 A 11/2014
CN 104282263 A 1/2015
(Continued)

OTHER PUBLICATIONS

International Search Report & Written Opinion dated Aug. 27, 2019, regarding PCT/CN2018/116946.

*Primary Examiner* — Muhammad N Edun
(74) *Attorney, Agent, or Firm* — Intellectual Valley Law, P.C.

(57) ABSTRACT

The present application discloses display-driving circuit for multiple rows of pixels in a column of a display panel. The display-driving circuit includes a compensation sub-circuit comprising a driving transistor, a data-input transistor, a drive-control transistor, a reset transistor, and a capacitor. The compensation sub-circuit is configured to compensate a drift of a threshold voltage of the driving transistor to drive light emission of multiple light-emitting diodes associated with respective multiple rows of pixels in the column. The display-driving circuit further includes multiple first emission-control transistors coupled in parallel between a high-voltage supply and a source electrode of the driving transistor and multiple second emission-control transistors respectively coupled between a drain electrode of the driving transistor and respective anodes of the multiple light-emitting diodes, and respectively turned on in different ones of multiple portions of one cycle time for displaying one frame of image.

18 Claims, 4 Drawing Sheets

(56) References Cited

U.S. PATENT DOCUMENTS

| | | | | |
|---|---|---|---|---|
| 2014/0160093 | A1* | 6/2014 | Chaji | G09G 3/3258 345/204 |
| 2015/0108437 | A1* | 4/2015 | Cho | H01L 27/3248 257/40 |
| 2015/0364085 | A1* | 12/2015 | Kanda | G09G 3/3233 345/214 |
| 2016/0247443 | A1 | 8/2016 | Yang | |
| 2017/0103701 | A1 | 4/2017 | Zhu et al. | |
| 2018/0226029 | A1* | 8/2018 | Park | G09G 3/3266 |

FOREIGN PATENT DOCUMENTS

| | | | |
|---|---|---|---|
| CN | 104505024 | A | 4/2015 |
| CN | 105225626 | A | 1/2016 |

* cited by examiner

DISPLAY-DRIVING CIRCUIT FOR MULTI-ROW PIXELS IN A SINGLE COLUMN, A DISPLAY APPARATUS, AND A DISPLAY METHOD

CROSS-REFERENCE TO RELATED APPLICATION

This application is a national stage application under 35 U.S.C. § 371 of International Application No. PCT/CN2018/116946, filed Nov. 22, 2018, the contents of which are incorporated by reference in the entirety.

TECHNICAL FIELD

The present invention relates to display technology, more particularly, to a display-driving circuit, a display apparatus having the same, and a display-driving method.

BACKGROUND

Low-temperature polycrystalline silicon (LTPS) based thin-film transistors (TFTs) are widely used in active-matrix organic light-emitting diode (AMOLED) display panel. Because of manufacture process variation for making these LTPS-based TFTs, different TFTs on the display panel have different threshold voltage. Due to the variation of threshold voltage, the driving current through each driving transistor for controlling light emission of each pixel on the display panel cannot be accurately controlled. One solution is to individually compensate the threshold voltage of the driving transistor associated with each pixel so that more uniform and delicate image can be displayed across the entire display panel. As demands for various high-resolution display apparatus increase, display panel made by LTPS-based TFTs has been pushed to its limit of the LTPS process, which merely results in a maximum resolution of 577 pixel-per-inch (PPI). When applications on virtual-reality/augment-reality displays become more popular and applications with smart phones become more and more diversified, OLED display panels based on TFTs under LTPS process with a resolution of 577 PPI cannot meet the demands for many display products desired for resolution of 1000 PPI or higher.

SUMMARY

In an aspect, the present disclosure provides a display-driving circuit for multiple rows of pixels in a column of a display panel. The display-driving circuit includes a compensation sub-circuit comprising a driving transistor, a data-input transistor, a drive-control transistor, a reset transistor, and a capacitor. The compensation sub-circuit is configured to compensate a drift of a threshold voltage of the driving transistor to drive light emission of multiple light-emitting diodes associated with respective multiple rows of pixels in the column. Additionally, the display-driving circuit includes multiple first emission-control transistors coupled in parallel between a high-voltage supply and a source electrode of the driving transistor and respectively turned on in different ones of multiple portions of one cycle time for displaying one frame of image. Furthermore, the display-driving circuit includes multiple second emission-control transistors respectively coupled between a drain electrode of the driving transistor and respective anodes of the multiple light-emitting diodes. Moreover, the multiple second emission-control transistors are respectively turned on in different ones of multiple portions of one cycle time for displaying one frame of image.

Optionally, the multiple first emission-control transistors include an n1 transistor and an n2 transistor. The multiple second emission-control transistors include an n3 transistor and an n4 transistor. The n1 transistor and the n3 transistor are configured to be turned on in a first portion of the multiple portions of one cycle time. The n2 transistor and the n4 transistor are configured to be turned on in a second portion of the multiple portions of one cycle time.

Optionally, the multiple first emission-control transistors and the multiple second emission-control transistors constitute multiple pairs of emission-control transistors. Each of the multiple pairs of emission-control transistors includes one of the multiple first emission-control transistors and one of the multiple second emission-control transistors. The display-driving circuit further includes multiple emission-control signal lines. Each of the multiple emission-control signal lines is coupled to gate electrodes of one of the multiple first emission-control transistors and one of the multiple second emission-control transistors in a respective pair of the multiple pairs of emission-control transistors.

Optionally, the multiple first emission-control transistors include an n1 transistor and an n2 transistor. The multiple second emission-control transistors includes an n3 transistor and an n4 transistor. The multiple pairs of emission-control transistors include a first pair and a second pair. The first pair includes the n1 transistor and the n3 transistor. The second pair includes the n2 transistor and the n4 transistor. The multiple emission-control signal lines include a first emission-control signal line coupled to gate electrodes of the n1 transistor and the n3 transistor and a second emission-control signal line coupled to gate electrodes of the n2 transistor and the n4 transistor.

Optionally, the capacitor includes a first electrode coupled to the high-voltage supply and a second electrode coupled to a gate electrode of the driving transistor. The reset transistor includes a source electrode coupled to a fixed voltage terminal, a drain electrode coupled to a gate electrode of the driving transistor, and a gate electrode coupled to a reset terminal. The data-input transistor includes a source electrode coupled to a data line associated with the column, a drain electrode coupled to the source electrode of the driving transistor, and a gate electrode coupled to one gate line corresponding to the multiple rows of pixels. The data-input transistor is configured to be turned on by a gate-driving signal provided to the gate line to allow a data voltage pulse provided to the data line to be applied to the source electrode of the driving transistor once in each of the multiple portions of one cycle time for displaying one frame of image. The drive-control transistor includes a source electrode coupled to the gate electrode of the driving transistor, a drain electrode coupled to the drain electrode of the driving transistor, and a gate electrode coupled to the gate line.

Optionally, each of the multiple first emission-control transistors includes a source electrode coupled to the high-voltage supply, a drain electrode coupled to the source electrode of the driving transistor, and a gate electrode being controlled by one of multiple emission-control signals. Each of the multiple second emission-control transistors is paired with the each of the multiple first emission-control transistors and includes a source electrode coupled to the drain electrode of the driving transistor, a drain electrode respectively coupled to one of the respective anodes of the multiple light-emitting diodes, and a gate electrode being controlled by the same one of the multiple emission-control signals.

Optionally, the gate electrodes of the multiple first emission-control transistors are respectively controlled by different ones of the multiple emission-control signals. The gate electrodes of the multiple second emission-control transistors are respectively controlled by different ones of the multiple emission-control signals. The gate electrodes of the one of the multiple first emission-control transistors and the one of the multiple second emission-control transistors in a same pair of the multiple pairs of emission-control transistors are controlled by a same one of the multiple emission-control signals.

Optionally, the driving transistor is configured to generate a drive current. The drive current is compensated by the compensation sub-circuit to be independent of the threshold voltage of the driving transistor. Each individual one of the multiple emission-control signals is configured to allow the drive current to pass through a respective one pair of the multiple pairs of emission-control transistors to drive light emission of a respective one of the multiple light-emitting diodes in respective one of the multiple portions of one cycle time based on a data voltage provided to a data line once in the respective one of the multiple portions of one cycle time.

Optionally, each of the multiple light-emitting diodes is a micro light-emitting diode based on gallium nitride.

Optionally, the multiple rows of pixels in a column include N number of rows of pixels in the column depending on one cycle of displaying one frame of image being divided into N number of portions controlled by a clock signal generator for generating N number of emission-control signals for turning on respectively N number of pairs of the first emission-control transistors and the second emission-control transistors. N is equal to or greater than 2.

In another aspect, the present disclosure provides a display apparatus including a display panel having a display-driving circuit described herein and provided for multiple rows of pixels in one column in the display panel.

In yet another aspect, the present disclosure provides a method of driving a display panel. The method includes providing a compensation sub-circuit for driving multiple rows of pixels in a column. The compensation sub-circuit includes a driving transistor, a data-input transistor, a drive-control transistor, a reset transistor, and a capacitor. The compensation sub-circuit is configured to compensate a drift of a threshold voltage of the driving transistor to drive light emission of multiple light-emitting diodes associated with respective multiple rows of pixels in the column. The method further includes respectively controlling multiple first emission-control transistors to respectively establish a connection between a high-voltage supply and a source electrode of the driving transistor respectively in different ones of multiple portions of one cycle time for displaying one frame of image. Additionally, the method includes respectively controlling multiple second emission-control transistors to respectively establish a connection between a drain electrode of the driving transistor and respective anodes of the multiple light-emitting diodes respectively in different ones of the multiple portions of the one cycle time for displaying one frame of image.

Optionally, the multiple first emission-control transistors include an n1 transistor and an n2 transistor. The multiple second emission-control transistors include an n3 transistor and an n4 transistor. The step of controlling multiple first emission-control transistors and controlling multiple second emission-control transistors includes turning on the n1 transistor and the n3 transistor in a first portion of the multiple portions of the one cycle time and turning on the n2 transistor and the n4 transistor in a second portion of the multiple portions of the one cycle time.

Optionally, the multiple first emission-control transistors and the multiple second emission-control transistors constitute multiple pairs of emission-control transistors. Each of multiple pairs of emission-control transistors includes one of the multiple first emission-control transistors and one of the multiple second emission-control transistors. The step of controlling multiple first emission-control transistors and controlling multiple second emission-control transistors include providing multiple emission-control signals to respective gate electrodes of one of the multiple first emission-control transistors and one of the multiple second emission-control transistors in a respective pair of the multiple pairs of emission-control transistors to respectively turn on the multiple pairs of emission-control transistors.

Optionally, the multiple first emission-control transistors include an n1 transistor and an n2 transistor. The multiple second emission-control transistors include an n3 transistor and an n4 transistor. The multiple pairs of emission-control transistors include a first pair and a second pair. The first pair includes the n1 transistor and the n3 transistor and the second pair includes the n2 transistor and the n4 transistor. The multiple emission-control signals include a first emission-control signal and a second emission-control signal. The step of controlling multiple first emission-control transistors and controlling multiple second emission-control transistors includes turning on the first pair using the first emission-control signal and turning on the second pair using the second emission-control signal.

Optionally, the step of providing multiple emission-control signals to respectively turn on the multiple pairs of emission-control transistors includes using each individual one of the multiple emission-control signals to turn on one of the multiple first emission-control transistors in a respective pair of the multiple pairs of emission-control transistors in at least one emission period of a respective one of the multiple portions of the one cycle time to control a voltage level of the source electrode of the driving transistor being set by a high voltage supply while turning off others of the multiple first emission-control transistors, and to turn on one of the multiple second emission-control transistors in respective pair of the multiple pairs of emission-control transistors in the at least one emission period to allow a drive current to drive light emission of a respective one of the multiple light-emitting diodes in the respective one of the multiple rows of pixels in the column while turning off others of the multiple second emission-control transistors.

Optionally, the step of providing multiple emission-control signals to respectively turn on the multiple pairs of emission-control transistors further includes applying a turn-off voltage to gate electrodes of the one of the multiple first emission-control transistors and the one of the multiple second emission-control transistors in the respective pair of the multiple pairs of emission-control transistors during a reset period and a data input and compensation period following the reset period in a respective one of the multiple portions of the one cycle time. Furthermore, the method includes applying a turn-on voltage to two gate electrodes of the one of the multiple first emission-control transistors and the one of the multiple second emission-control transistors in a respective pair of the multiple pairs of emission-control transistors during the emission period following the data input and compensation period.

Optionally, the method further includes dividing one cycle time of displaying one frame of image into the multiple portions by setting a clock signal generator for generating a same number of multiple emission-control signals in the one cycle time. Each portion includes sequentially a reset period, data input and compensation period, and an emission/non-emission period. Additionally, the method includes applying a reset signal at a turn-on voltage to a gate electrode of the reset transistor during the reset period and at a turn-off voltage during remaining periods in each of the multiple portions of the one cycle time. Furthermore, the method includes applying a gate-driving signal at a turn-on voltage to gate electrodes of the data-input transistor and the drive-control transistor during the data input and compensation period and at a turn-off voltage during remaining periods in the each of the multiple portions of the one cycle time. Moreover, the method includes applying a data signal to a data line in the data input and compensation period in the each of the multiple portions of the one cycle time.

Optionally, the method further includes applying one emission-control signal at a turn-on voltage to one gate electrode of only one of the multiple first emission-control transistors and another gate electrode of only one of the multiple second emission-control transistors while applying other emission-control signals at a turn-off voltage to other gate electrodes of remaining ones of the multiple first emission-control transistors and remaining ones of the multiple second emission-control transistors during the emission/non-emission period in each of the multiple portions of the one cycle time. The emission/non-emission period has a start point slightly delayed from an end point of the data input and compensation period of the each of the multiple portions of the one cycle time.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Thin-film transistors, especially those made by low-temperature polycrystalline silicon process, are widely applied for making a light-emitting display panel on glass substrate. In order to eliminate manufacture non-uniformity in the thin-film transistors, the threshold voltage of each driving transistor in respective pixel driving circuit needs to be compensated by adding a compensation sub-circuit to the pixel driving circuit. Typically, the compensation sub-circuit includes multiple transistors and at least one capacitor. Adding these transistors or capacitors, to some degrees, limits a size of each light-emitting unit, i.e., pixel, in the display panel.

Accordingly, the present disclosure provides, inter alia, a display-driving circuit for multiple rows of pixels in a single column of a display panel, a display apparatus having the same, and a display-driving method thereof that substantially obviate one or more of the problems due to limitations and disadvantages of the related art. In one aspect, the present disclosure provides a display-driving circuit sharing a compensation sub-circuit for driving multiple light-emitting diodes associated with multiple rows of pixels.

Figure 1:
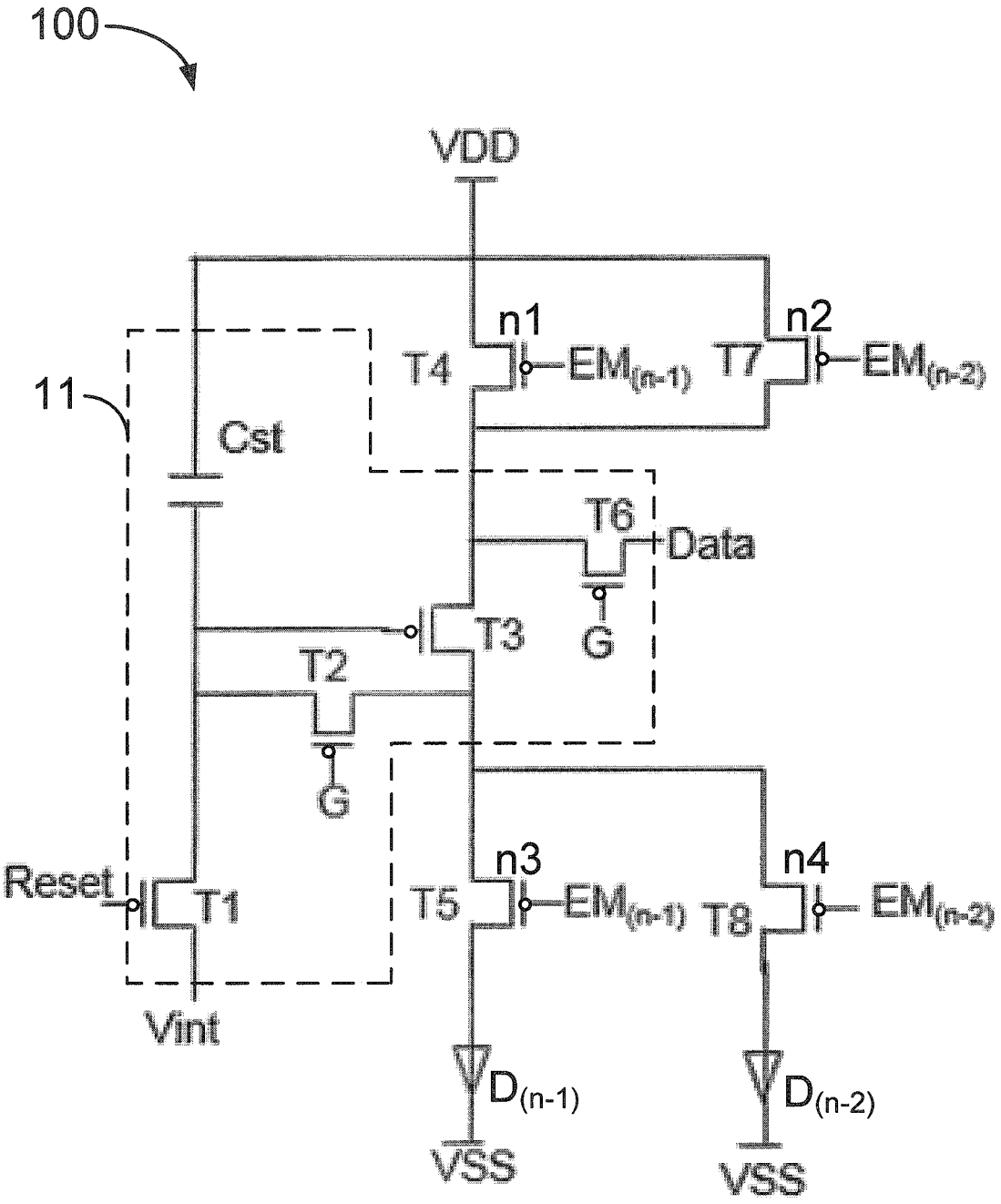
FIG. 1 is a circuit diagram of a display-driving circuit sharing a compensation sub-circuit for multiple rows of pixels according to some embodiments of the present disclosure.

FIG. 1 is a circuit diagram of a display-driving circuit sharing a compensation sub-circuit for multiple rows of pixels in a display panel according to some embodiments of the present disclosure. Referring to FIG. 1, the display-driving circuit 100 includes a compensation sub-circuit 11 containing a driving transistor T3, a data-input transistor T6, a drive-control transistor T2, a reset transistor T1, and a storage capacitor Cst. The compensation sub-circuit 11 is configured to compensate a drift of a threshold voltage Vth of the driving transistor T3 to drive light emission of multiple light-emitting diodes $D_{(n-1)}$, $D_{(n-2)}$ or more, associated with respective multiple rows of pixels in the column in the display panel. Additionally, the display-driving circuit 100 includes multiple first emission-control transistors T4, T7 or more, coupled in parallel between a high-voltage supply VDD and a source electrode of the driving transistor T3 and respectively turned on in different ones of multiple portions of one cycle time for displaying one frame of image. Furthermore, the display-driving circuit 100 includes multiple second emission-control transistors T5, T8 or more, respectively coupled between a drain electrode of the driving transistor T3 and respective anodes of the multiple light-emitting diodes $D_{(n-1)}$, $D_{(n-2)}$ or more, and respectively turned on in different ones of multiple portions of one cycle time for displaying one frame of image.

Optionally, the multiple first emission-control transistors and the multiple second emission-control transistors constitute multiple pairs of emission-control transistors. Each of the multiple pairs includes one of the multiple first emission-control transistors and one of the multiple second emission-control transistors. For example, a first pair includes transistor T4 and transistor T5. A second pair includes transistor T7 and transistor T8. Optionally, the display-driving circuit 100 also includes multiple emission-control signal lines EMs, such as $EM_{(n-1)}$, $EM_{(n-2)}$ or more, respectively associated with multiple rows of pixels in the display panel. Optionally, the multiple rows of pixels are nearest neighboring rows of pixels in the display panel. Optionally, the multiple rows of pixel are not all nearest neighbors. Each of the multiple emission-control signal lines EMs is coupled to respective gate electrodes of one of the multiple first emission-control transistors and one of the multiple second emission-control transistors in a respective pair of the multiple pairs of emission-control transistors. For example, one emission-control signal from the emission-control line $EM_{(n-1)}$ is configured to be applied to gate electrodes of the first pair of transistors T4 and T5. Another one emission-control signal from the emission-control line $EM_{(n-2)}$ is configured to be applied to gate electrodes of the second pair of transistors T7 and T8.

Referring to FIG. 1, in an embodiment of the display-driving circuit 100 the capacitor Cst includes a first electrode coupled to the high-voltage supply VDD and a second electrode coupled to agate electrode of the driving transistor T3. The reset transistor T1 includes a source electrode coupled to a fixed voltage terminal Vint, a drain electrode coupled to a gate electrode of the driving transistor T3, and a gate electrode coupled to a reset control terminal Reset. The data-input transistor T6 includes a source electrode coupled to a data line Data associated with the column of pixels in the display panel, a drain electrode coupled to the source electrode of the driving transistor T3, and a gate electrode coupled to one gate line G corresponding to the multiple rows of pixels in the display panel. Optionally, the data-input transistor T6 is configured to be turned on by a gate-driving signal provided to the gate line G to allow a data voltage pulse provided to the data line Data to be applied to the source electrode of the driving transistor T3 once in each of the multiple portions of one cycle time for displaying one frame of image. Additionally, the drive-control transistor T2 includes a source electrode coupled to the gate electrode of the driving transistor T3, a drain electrode coupled to the drain electrode of the driving transistor T3, and a gate electrode coupled to the gate line G. Optionally, the gate line G of the display-driving circuit is associated with one row of pixels in the display panel.

Figure 2:
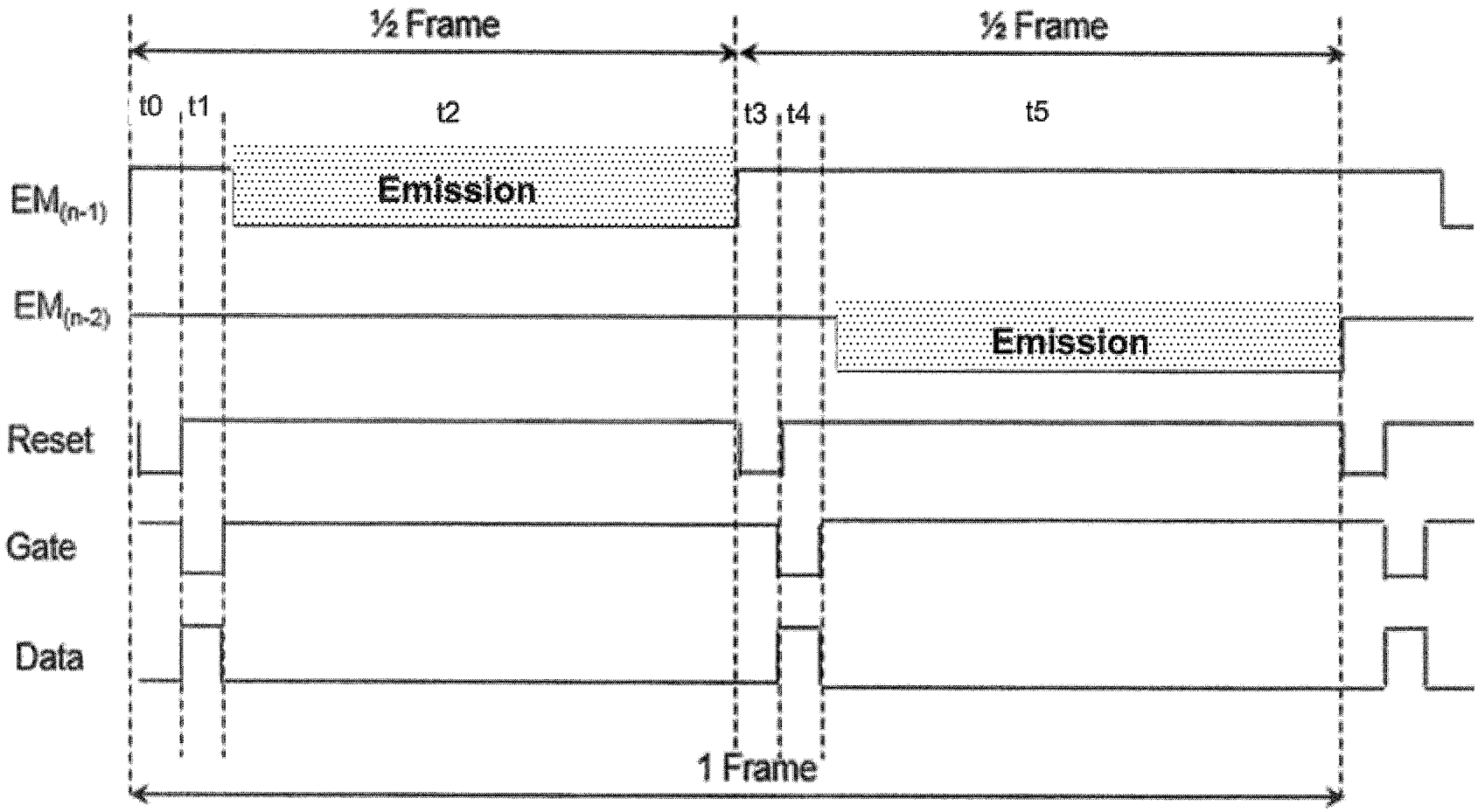
FIG. 2 is an exemplary timing waveform of multiple signals provided for operating the display-driving circuit of FIG. 1 in one cycle time of displaying one frame of image according to some embodiments of the present disclosure.

FIG. 2 is an exemplary timing waveform of multiple signals provided for operating the display-driving circuit of FIG. 1 in one cycle time of displaying one frame of image according to some embodiments of the present disclosure. In the example, one cycle time of displaying one frame of image includes a first portion related to a first ½ frame and a second portion related to a second ½ frame. Accordingly, as shown specifically in FIG. 1, the multiple first emission-control transistors include two transistors: an n1 transistor and an n2 transistor; the multiple second emission-control transistors include two other transistors: an n3 transistor and an n4 transistor. The n1 transistor and the n3 transistor form a first pair of emission-control transistors configured to be turned on once in the first portion of the one cycle time. The n2 transistor and the n4 transistor form a second pair of emission-control transistors configured to be turned on once in the second portion of the one cycle time.

In the embodiment, the multiple emission-control signal lines EMs includes a first emission-control signal line $EM_{(n-1)}$ associated with an (n−1)-th row of pixels in one column in the display panel. The first emission-control signal line $EM_{(n-1)}$ is coupled to gate electrodes of the first pair of emission-control transistors. A second emission-control signal line $EM_{(n-2)}$ is associated with an (n−2)-th row of pixels in the same column in the display panel and is coupled to gate electrodes of the second pair of emission-control transistors. In other words, the display-driving circuit 100 in this example is configured to have one common compensation sub-circuit 11 to generate a drive current to drive pixels from the two rows of the same column in the display panel. The one common compensation sub-circuit is functionally shared by two rows of pixels in the same column. Optionally, the compensation sub-circuit in the display-driving circuit 100 can be shared by two or more rows of pixels in the same column in the display panel to support higher PPI resolution by using a smaller number of transistors per pixel.

In particular, a turn-on voltage can be applied to the first emission-control signal line $EM_{(n-1)}$ to turn on the n1 transistor to connect the source electrode of the driving transistor T3 to the high-voltage supply VDD and turn on the n3 transistor at the same time to connect the drain electrode of the driving transistor T3 to the anode of a respective light-emitting diode $D_{(n-1)}$ associated with the pixel in the (n−1)-th row. This establish an electrical path for the drive current generated by the driving transistor T3 to flow to the corresponding light-emitting diode $D_{(n-1)}$ to produce light for the particular pixel. Optionally, the turn-on voltage is applied to the first emission-control line $EM_{(n-1)}$ in the first ½ frame of the one cycle time to turn on the first pair of emission-control transistors, i.e., n1 transistor and n3 transistor. In the second ½ frame of the same cycle time, a turn-off voltage is applied to the first emission-control line $EM_{(n-1)}$ to turn off the first pair of emission-control transistors. In other words, the light-emitting diode $D_{(n-1)}$ is potentially to emit light (depending on particular data signal) during the first portion of the one cycle time while is set to not emit light during the second portion of the same one cycle time. Alternatively, a turn-off voltage can be applied to the second emission-control signal line $EM_{(n-2)}$ to turn off the second pair of emission-control transistors. i.e., the n2 transistor and the n4 transistor, once during the first ½ frame and a turn-on voltage is then applied to turn on the second pair of emission-control transistors during the second ½ frame. Thus, the light-emitting diode $D_{(n-2)}$ is set to not emit light during the first portion of the one cycle time while is set to potentially emit light (depending on data signal) during the second portion of the same one cycle time.

Referring to FIG. 2, in one example, each portion of one cycle time includes a reset period, a data input and compensation period following the reset period, and an emission/non-emission period following the data input and compensation period. In this example, one cycle time is divided to two ½ portions. Or, one frame is divided to two ½ frames. The first ½ frame includes a reset period to, a data input and compensation period t1, and an emission/non-emission period t2. The emission/non-emission period t2 can be a period for the light-emitting diode $D_{(n-1)}$ in (n−1)-th row to emit light or a same period for the light-emitting diode $D_{(n-2)}$ in the (n−2)-th row to not emit light. Similarly, the second ½ frame includes a reset period t3, a data input and compensation period t4, and an emission/non-emission period t5. The emission/non-emission period t5 can be configured to be a period for the light-emitting diode $D_{(n-1)}$ in (n−1)-th row to not emit light or a same period for the light-emitting diode $D_{(n-2)}$ in the (n−2)-th row to emit light. Optionally, the (n−1)-th row and the (n−2)-th row are two adjacent rows in the display panel. Optionally, the (n−1)-th row and the (n−2)-th row are two non-adjacent rows.

Optionally, the one cycle time can be divided to multiple (>2) portions by setting a clock signal generator for generating a same number of emission-control signals in the one cycle time. In those cases, the display-driving circuit of the present disclosure can be operated to have the compensation sub-circuit shared by the same number of rows of pixels in a same column in the display panel to support higher PPI resolution by using a smaller number of transistors per pixel.

In a specific embodiment, referring to FIG. 1 and FIG. 2, in the reset period (t0 or t3) of each portion of the multiple portions of one cycle time, a reset signal at a turn-on voltage is provided to the reset control terminal Reset to reset a voltage level Vg of the gate electrode of the driving transistor T3 by a fixed voltage supply Vint, i.e., Vg=Vint. Optionally, the fixed voltage supply Vint provides a low voltage level that is a turn-on voltage to turn on the driving transistor T3 if the driving transistor is a P-type transistor. Both emission-control signals from the emission-control line $EM_{(n-1)}$ and the emission-control line $EM_{(n-2)}$ are provided with high voltage level that is a turn-off voltage to turn all the emission-control transistors T4, T5, T7, and T8 off.

In the data input and compensation period (t1 or t4), agate-driving signal is provided to the gate line G with a turn-on voltage (a low voltage level in this example) so that both the drive-control transistor T2 and the data-input transistor T6 are turned on (see FIG. 1). The drive-control transistor T2 is turned on to make the voltage level of the gate electrode of the driving transistor T3 to be equal to a voltage level of the drain electrode of the driving transistor T3. Substantially in the same period, a data signal Vdata is provided to the data line Data with either a high voltage level or a low voltage level. Transistor T6 is turned on to allow this data signal Vdata to be passed to the source electrode of the driving transistor T3, i.e., Vs=Vdata. The driving transistor T3 is on due to its gate voltage level Vg=Vint so that a voltage level at the drain electrode is changed to Vs−Vth=Vdata−Vth. Vth is a threshold voltage of the driving transistor T3. The drive-control transistor T2 is turned on to allow the voltage level at the gate electrode Vg=Vdata−Vth at the end of this data input and compensation period (t1 or t4). Again, in this period (t1 or t4), the emission-control signals from the emission-control line $EM_{(n-1)}$ and the emission-control line $EM_{(n-2)}$ are provided with the turn-off voltage to keep the transistors T4, T5, T7, and T8 off. Optionally, the data signal Vdata loaded in the period t1 can be the same as that loaded in the period t4. Optionally, the data signal Vdata loaded in the period t1 can be different from that loaded in the period t4 even though both t1 and t4 belong to a same cycle time for displaying a frame of image.

Further in the emission/non-emission period, t2 or t5, gate driving signal from the gate line G is off and data signal is no longer passed to the source electrode of the driving transistor. In the emission/non-emission period t2, the emission-control signal from $EM_{(n-1)}$ is a turn-on voltage to turn transistor T4 and transistor T5 on while the emission-control signal from $EM_{(n-2)}$ is a turn-off voltage to turn transistor T7 and transistor T8 off. Transistor T4 is turned on to allow a high voltage VDD from the high voltage supply to be passed to the source electrode of the driving transistor T3. The voltage level Vg=Vdata−Vth at the gate electrode of the driving transistor, setting the driving transistor in a saturation mode to yield a drive current I that is depended only on Vdata and VDD but independent of the threshold voltage Vth. At the same time, Transistor T5 is turned on to allow the drive current $I_d$ to flow to the light-emitting diode $D_{(n-1)}$ to drive it to emit light. In the same period t2, Transistors T7 and T8 are off, no drive current is flowing through the light-emitting diode $D_{(n-2)}$, leading to no light emission therefrom.

Similarly, in the emission-control period t5, the emission-control signal from $EM_{(n-1)}$ is a turn-off voltage to turn transistor T4 and transistor T5 off while the emission-control signal from $EM_{(n-2)}$ is a turn-on voltage to turn transistor T7 and transistor T8 on. T7 plays a same role as transistor T4 in period t2 and transistor T8 plays a same role as transistor T5 in period t2. As a result, the light-emitting diode $D_{(n-2)}$ is driven by the drive current to emit light while the light-emitting diode $D_{(n-1)}$ emits no light in the period t5.

Figure 3:
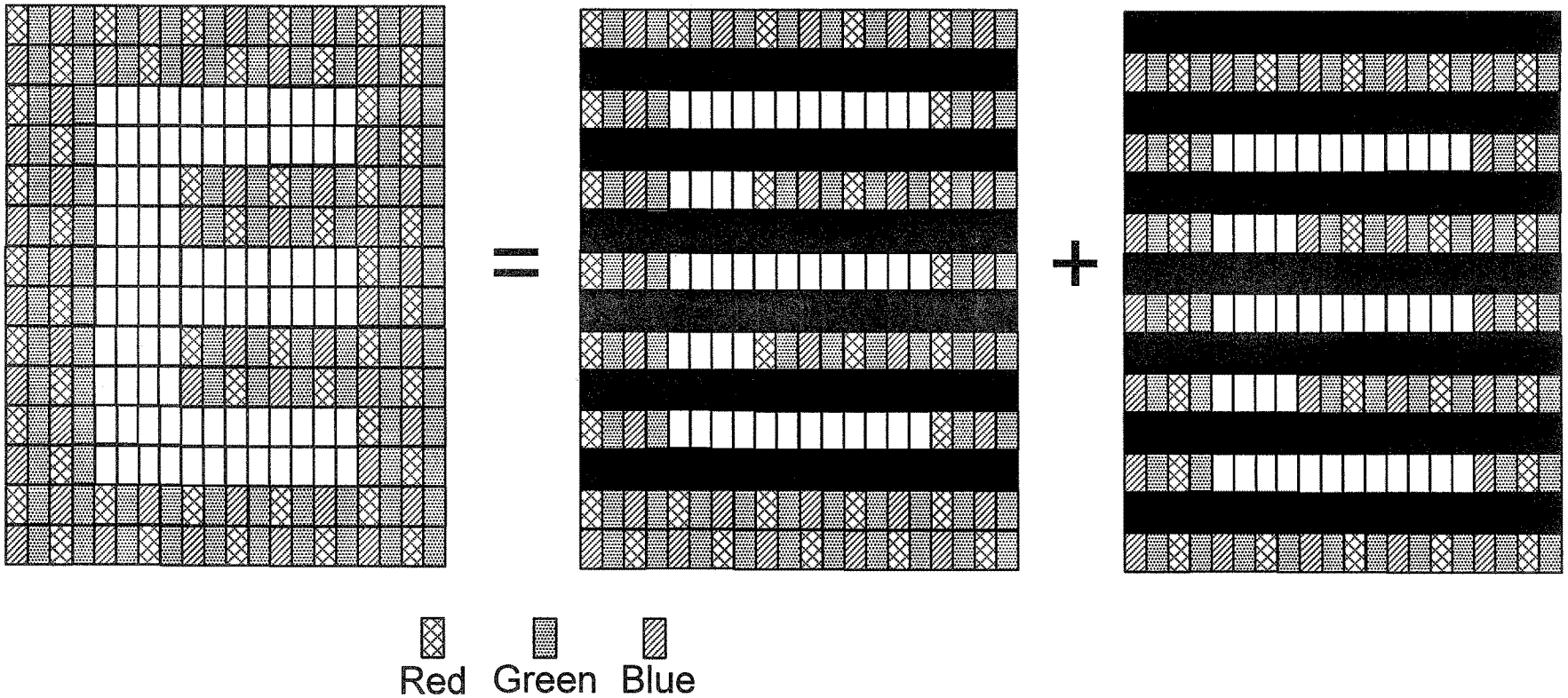
FIG. 3 is an example of one frame of image based on images from two ½ frames according to an embodiment of the present disclosure.

In summary, displaying one frame of image can be accomplished by controlling ON and OFF of the emission-control signals from two emission-control lines $EM_{(n-1)}$ and $EM_{(n-2)}$ to control light emission from either the light-emitting diode $D_{(n-1)}$ or the light-emitting diode $D_{(n-2)}$ in two different portions of one cycle time. FIG. 3 is an example of one frame of image based on images from two ½ frames (see FIG. 2) according to an embodiment of the present disclosure. Referring to FIG. 3, the exemplary image "E" is superposition of two images, one being obtained in the first ½ frame of the cycle time with $D_{(n-1)}$ emitting light and $D_{(n-2)}$ not emitting light and another being obtained in the second ½ frame of the cycle time with $D_{(n-1)}$ not emitting light and $D_{(n-2)}$ emitting light.

Optionally, for a display-driving circuit disclosed herein has a common compensation sub-circuit shared by a number N (N>2) of rows of pixels in a column in a display panel, the cycle time for displaying one frame of image is also divided to N portions. The display-driving circuit thus also is driven by N independent emission-control signals for respectively controlling N pairs of emission-control transistors each with one being connected between a voltage supply terminal and a source electrode of a driving transistor and another one being connected between a drain electrode of the same driving transistor and an anode of a light-emitting diode. In each portion of the N portions of one cycle time, only one of the N pairs of emission-control transistors are turned on controlled by one of the N independent emission-control signals to allow a drive current to pass to the respective one light-emitting diode to allow it to emit light. All remaining pairs of emission-control transistors are turned off to have corresponding light-emitting diodes not to emit light thereof. In a next portion of the cycle time, another pair of the N pairs of emission-control transistors are turned on while all remaining pairs of emission-control transistors are off to allow another light-emitting diode to emit light while all rest light-emitting diodes not to emit light. And the display-driving circuit is operated by repeating the above process for rest of the N portions. In the end, each frame of image displayed includes a superposition of N number of 1/N frames. For a viewer, the frame of image displayed by the display panel using the display-driving circuit of the present disclosure appears exactly the same as one frame of image obtained once in a single cycle time. But, since the display-driving circuit shares the compensation sub-circuit, e.g., a 6T1C circuit, with N number of rows of pixels, the average number of transistors per pixel is reduced, allowing the display panel to support higher resolution, such as 1000 PPI or higher.

Figure 4:
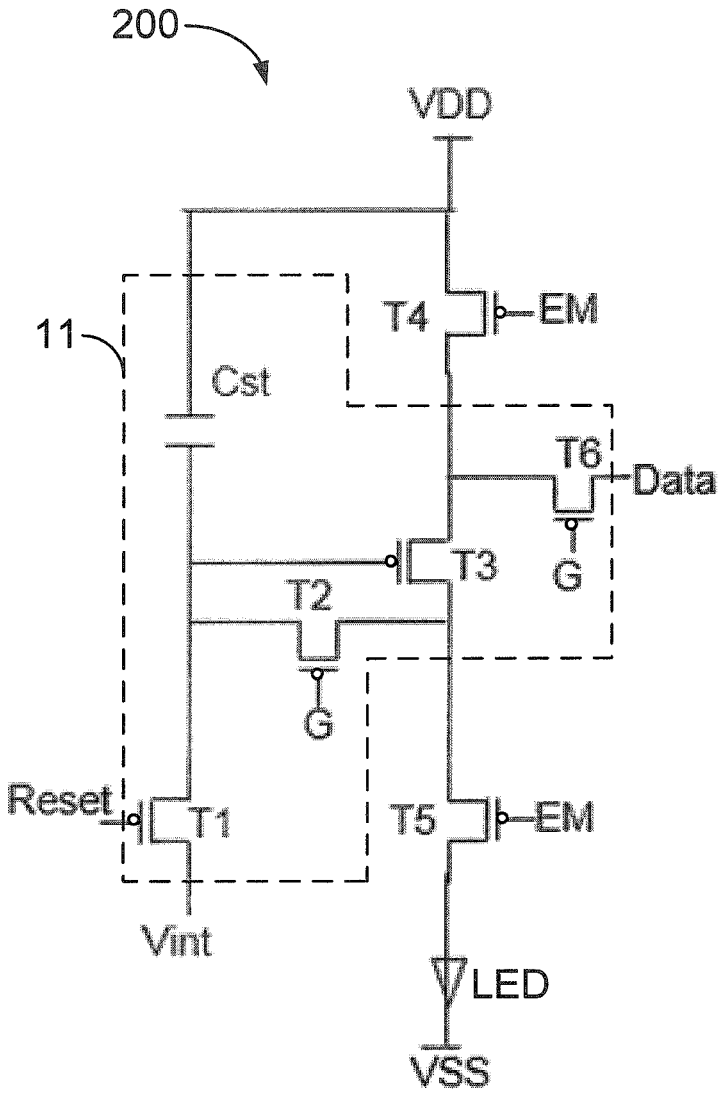
FIG. 4 is a circuit diagram of a pixel driving circuit without sharing the compensation sub-circuit for multiple rows of pixels.

For example, FIG. 4 is a circuit diagram of a 6T1C pixel driving circuit without sharing the compensation sub-circuit for multiple rows of pixels. In a conventional scheme, to drive two rows of pixels of one column in a display panel, it needs (6T1C)×2=12T2C, i.e., 12 transistors (including two driving transistors) and 2 capacitors. As the display-driving circuit 100 is provided, as shown in FIG. 1, it only needs 8 transistors and 1 capacitor. Therefore, in this example, 4 transistors are saved in the display-driving circuit for driving two pixels. Because less numbers of transistors are used for making the (AMOLED) display panel, more pixels can be packed into a same sized display panel, making the display panel to have higher PPI resolution.

In another aspect, the present disclosure provides a method of driving a display panel described herein for obtaining a frame of image in one cycle time being a superposition of multiple partial frame of images respectively obtained in multiple portions of the one cycle time. The method includes providing a compensation sub-circuit for driving multiple rows of pixels in a column of the display panel. The compensation sub-circuit includes a driving transistor, a data-input transistor, a drive-control transistor, a reset transistor, and a capacitor, and is configured to compensate a drift of a threshold voltage of the driving transistor to drive light emission of multiple light-emitting diodes associated with respective multiple rows of pixels in the column of the display panel. Additionally, the method includes respectively controlling multiple first emission-control transistors to respectively establish a connection between a high-voltage supply and a source electrode of the driving transistor respectively in different ones of multiple portions of the one cycle time. Furthermore, the method includes respectively controlling multiple second emission-control transistors to respectively establish a connection between a drain electrode of the driving transistor and respective anodes of the multiple light-emitting diodes respectively in different ones of the multiple portions of the one cycle time.

Optionally, the multiple first emission-control transistors and the multiple second emission-control transistors constitute multiple pairs of emission-control transistors, each of which includes one of the multiple first emission-control transistors and one of the multiple second emission-control transistors. The steps of controlling multiple first emission-control transistors and controlling multiple second emission-control transistors include providing multiple emission-control signals to respective gate electrodes of one of the multiple first emission-control transistors and one of the multiple second emission-control transistors in a respective pair of the multiple pairs of emission-control transistors to respectively turn on only one of the multiple pairs of emission-control transistors in respective one of multiple portions of the one cycle time.

Optionally, the multiple first emission-control transistors include an n1 transistor and an n2 transistor and the multiple second emission-control transistors includes an n3 transistor and an n4 transistor. The multiple pairs of emission-control transistors include a first pair and a second pair, the first pair including the n1 transistor and the n3 transistor, the second pair including the n2 transistor and the n4 transistor. The multiple emission-control signals include a first emission-control signal and a second emission-control signal. The steps of controlling multiple first emission-control transistors and controlling multiple second emission-control transistors include turning on the first pair using the first emission-control signal and turning on the second pair using the second emission-control signal.

Optionally, the steps of controlling include applying a turn-off voltage to gate electrodes of the one of the multiple first emission-control transistors and the one of the multiple second emission-control transistors in the respective pair of the multiple pairs of emission-control transistors during a reset period and a data input and compensation period following the reset period in a respective one of the multiple portions of the one cycle time. Additionally, the steps of controlling include applying a turn-on voltage to two gate electrodes of the one of the multiple first emission-control transistors and the one of the multiple second emission-control transistors in a respective pair of the multiple pairs of emission-control transistors during an emission period following the data input and compensation period.

Optionally, the method of driving the display-driving circuit includes dividing one cycle time of displaying one frame of image into the multiple portions by setting a clock signal generator for generating a same number of multiple emission-control signals in the one cycle time. Each portion of the multiple portions includes sequentially a reset period, data input and compensation period, and an emission/non-emission period. Additionally, the method includes applying a reset signal at a turn-on voltage to the gate electrode of the reset transistor during the reset period and at a turn-off voltage during remaining periods in each of the multiple portions of one cycle time. Furthermore, the method includes applying a gate-driving signal at a turn-on voltage to the gate electrodes of the data-input transistor and the drive-control transistor during the data input and compensation period and at a turn-off voltage during remaining periods in the each of the multiple portions of the one cycle time. Moreover, the method includes applying a data signal to the data line in the data input and compensation period in the each of the multiple portions of the one cycle time.

Additionally, the method further includes applying one emission-control signal at a turn-on voltage to one gate electrode of only one of the multiple first emission-control transistors and another gate electrode of only one of the multiple second emission-control transistors while applying other emission-control signals at a turn-off voltage to other gate electrodes of remaining ones of the multiple first-emission-control transistors and remaining ones of the multiple second emission-control transistors during the emission/non-emission period in each of the multiple portions of the one cycle time. The emission/non-emission period has a start point slightly delayed from an end point of the data input and compensation period of the each of the multiple portions of the one cycle time.

In yet another aspect, the present disclosure provides a display apparatus. The display apparatus includes a display panel having a display-driving circuit described herein that is provided for multiple rows of pixels in one column in the display panel. The display-driving circuit includes a compensation sub-circuit containing a driving transistor, a data-input transistor, a drive-control transistor, a reset transistor, and a capacitor. The compensation sub-circuit is configured to compensate a drift of a threshold voltage of the driving transistor to drive light emission of multiple light-emitting diodes associated with respective multiple rows of pixels in the column in the display panel. Additionally, the display-driving circuit includes multiple first emission-control transistors coupled in parallel between a high-voltage supply and a source electrode of the driving transistor and respectively turned on in different ones of multiple portions of one cycle time for displaying one frame of image, and multiple second emission-control transistors respectively coupled between a drain electrode of the driving transistor and respective anodes of the multiple light-emitting diodes, and respectively turned on in different ones of multiple portions of one cycle time for displaying one frame of image.

Optionally, each of the multiple light-emitting diodes is an organic light-emitting diode. Optionally, each of the multiple light-emitting diodes is a micro light-emitting diode made by gallium nitride material. Optionally, the display panel is an active-matrix organic light-emitting diode display panel, configured to support high resolution with 1000 PPI or higher. Optionally, the display panel is micro LED panel. Examples of appropriate display apparatuses include, but are not limited to, an electronic paper, a mobile phone, a tablet computer, a television, a monitor, a notebook computer, a digital album, a GPS, etc. In one example, the display apparatus is a smart watch. Optionally, the display apparatus is an organic light emitting diode display apparatus.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display-driving circuit for multiple rows of pixels in a column of a display panel comprising:

a compensation sub-circuit comprising a driving transistor, a data-input transistor, a drive-control transistor, a reset transistor, and a capacitor, the compensation sub-circuit being configured to compensate a drift of a threshold voltage of the driving transistor to drive light emission of multiple light-emitting diodes associated with respective multiple rows of pixels in the column;

multiple first emission-control transistors coupled in parallel between a high-voltage supply and a source electrode of the driving transistor and respectively turned on in different ones of multiple portions of one cycle time for displaying one frame of image; and multiple second emission-control transistors respectively coupled between a drain electrode of the driving transistor and respective anodes of the multiple light-emitting diodes, and respectively turned on in different ones of multiple portions of one cycle time for displaying one frame of image;

wherein the multiple first emission-control transistors comprise an n1 transistor and an n2 transistor;

the multiple second emission-control transistors comprise an n3 transistor and an n4 transistor;

the n1 transistor and the n3 transistor are configured to be turned on in a first portion of the multiple portions of one cycle time; and the n2 transistor and the n4 transistor are configured to be turned on in a second portion of the multiple portions of one cycle time.

2. The display-driving circuit of claim 1, wherein the capacitor comprises a first electrode coupled to the high-voltage supply and a second electrode coupled to a gate electrode of the driving transistor;

the reset transistor comprises a source electrode coupled to a fixed voltage terminal, a drain electrode coupled to a gate electrode of the driving transistor, and a gate electrode coupled to a reset terminal;

the data-input transistor comprises a source electrode coupled to a data line associated with the column, a drain electrode coupled to the source electrode of the driving transistor, and a gate electrode coupled to one gate line corresponding to the multiple rows of pixels, wherein the data-input transistor is configured to be turned on by a gate-driving signal provided to the gate line to allow a data voltage pulse provided to the data line to be applied to the source electrode of the driving transistor once in each of the multiple portions of one cycle time for displaying one frame of image; and the drive-control transistor comprises a source electrode coupled to the gate electrode of the driving transistor, a drain electrode coupled to the drain electrode of the driving transistor, and a gate electrode coupled to the gate line.

3. The display-driving circuit of claim 1, wherein each of the multiple light-emitting diodes is a micro light-emitting diode based on gallium nitride.

4. The display-driving circuit of claim 1, wherein the multiple rows of pixels in the column comprises N number of rows of pixels in the column depending on one cycle of displaying one frame of image being divided into N number of portions controlled by a clock signal generator for generating N number of emission-control signals for turning on respectively N number of pairs of the first emission-control transistors and the second emission-control transistors, wherein N is equal to or greater than 2.

5. A display apparatus comprising a display panel having a display-driving circuit of claim 1 provided for multiple rows of pixels in one column in the display panel.

6. A display-driving circuit for multiple rows of pixels in a column of a display panel comprising:

a compensation sub-circuit comprising a driving transistor, a data-input transistor, a drive-control transistor, a reset transistor, and a capacitor, the compensation sub-circuit being configured to compensate a drift of a threshold voltage of the driving transistor to drive light emission of multiple light-emitting diodes associated with respective multiple rows of pixels in the column;

multiple first emission-control transistors coupled in parallel between a high-voltage supply and a source electrode of the driving transistor and respectively turned on in different ones of multiple portions of one cycle time for displaying one frame of image; and multiple second emission-control transistors respectively coupled between a drain electrode of the driving transistor and respective anodes of the multiple light-emitting diodes, and respectively turned on in different ones of multiple portions of one cycle time for displaying one frame of image;

wherein the multiple first emission-control transistors and the multiple second emission-control transistors constitute multiple pairs of emission-control transistors, each of the multiple pairs of emission-control transistors comprises one of the multiple first emission-control transistors and one of the multiple second emission-control transistors; and wherein the display-driving circuit further comprises multiple emission-control signal lines, each of the multiple emission-control signal lines is coupled to gate electrodes of one of the multiple first emission-control transistors and one of the multiple second emission-control transistors in a respective pair of the multiple pairs of emission-control transistors.

7. The display-driving circuit of claim 6, wherein the multiple first emission-control transistors comprise an n1 transistor and an n2 transistor;

the multiple second emission-control transistors comprise an n3 transistor and an n4 transistor;

the multiple pairs of emission-control transistors comprise a first pair and a second pair, the first pair comprising the n1 transistor and the n3 transistor, the second pair comprising the n2 transistor and the n4 transistor; and the multiple emission-control signal lines comprise a first emission-control signal line coupled to gate electrodes of the n1 transistor and the n3 transistor, and a second emission-control signal line coupled to gate electrodes of the n2 transistor and the n4 transistor.

8. The display-driving circuit of claim 6, wherein each of the multiple first emission-control transistors comprises a source electrode coupled to the high-voltage supply, a drain electrode coupled to the source electrode of the driving transistor, and a gate electrode being controlled by one of multiple emission-control signals; and each of the multiple second emission-control transistors is paired with the each of the multiple first emission-control transistors and comprises a source electrode coupled to the drain electrode of the driving transistor, a drain electrode respectively coupled to one of the respective anodes of the multiple light-emitting diodes, and a gate electrode being controlled by the same one of the multiple emission-control signals.

9. The display-driving circuit of claim 8, wherein the gate electrodes of the multiple first emission-control transistors are respectively controlled by different ones of the multiple emission-control signals;

the gate electrodes of the multiple second emission-control transistors are respectively controlled by different ones of the multiple emission-control signals; and the gate electrodes of the one of the multiple first emission-control transistors and the one of the multiple second emission-control transistors in a same pair of the multiple pairs of emission-control transistors are controlled by a same one of the multiple emission-control signals.

10. The display-driving circuit of claim 8, wherein the driving transistor is configured to generate a drive current, the drive current being compensated by the compensation sub-circuit to be independent of the threshold voltage of the driving transistor, wherein each individual one of the multiple emission-control signals is configured to allow the drive current to pass through a respective one pair of the multiple pairs of emission-control transistors to drive light emission of a respective one of the multiple light-emitting diodes in a respective one of the multiple portions of one cycle time based on a data voltage provided to a data line once in the respective one of the multiple portions of one cycle time.

11. A method of driving a display panel comprising:

providing a compensation sub-circuit for driving multiple rows of pixels in a column, the compensation sub-circuit comprising a driving transistor, a data-input transistor, a drive-control transistor, a reset transistor, and a capacitor, and being configured to compensate a drift of a threshold voltage of the driving transistor to drive light emission of multiple light-emitting diodes associated with respective multiple rows of pixels in the column;

respectively controlling multiple first emission-control transistors to respectively establish a connection between a high-voltage supply and a source electrode of the driving transistor respectively in different ones of multiple portions of one cycle time for displaying one frame of image; and respectively controlling multiple second emission-control transistors to respectively establish a connection between a drain electrode of the driving transistor and respective anodes of the multiple light-emitting diodes respectively in different ones of the multiple portions of the one cycle time for displaying one frame of image;

wherein the multiple first emission-control transistors comprise an n1 transistor and an n2 transistor;

the multiple second emission-control transistors comprise an n3 transistor and an n4 transistor;

wherein controlling multiple first emission-control transistors and controlling multiple second emission-control transistors comprises:

turning on the n1 transistor and the n3 transistor in a first portion of the multiple portions of the one cycle time; and turning on the n2 transistor and the n4 transistor in a second portion of the multiple portions of the one cycle time.

12. The method of claim 11, wherein the multiple first emission-control transistors and the multiple second emission-control transistors constitute multiple pairs of emission-control transistors, each of which comprises one of the multiple first emission-control transistors and one of the multiple second emission-control transistors; and wherein controlling multiple first emission-control transistors and controlling multiple second emission-control transistors comprise providing multiple emission-control signals to respective gate electrodes of one of the multiple first emission-control transistors and one of the multiple second emission-control transistors in a respective pair of the multiple pairs of emission-control transistors to respectively turn on the multiple pairs of emission-control transistors.

13. The method of claim 12, wherein the multiple first emission-control transistors comprise an n1 transistor and an n2 transistor;

the multiple second emission-control transistors comprise an n3 transistor and an n4 transistor;

the multiple pairs of emission-control transistors comprise a first pair and a second pair, the first pair comprising the n1 transistor and the n3 transistor, the second pair comprising the n2 transistor and the n4 transistor;

the multiple emission-control signals comprise a first emission-control signal and a second emission-control signal;

wherein controlling multiple first emission-control transistors and controlling multiple second emission-control transistors comprise:

turning on the first pair using the first emission-control signal; and turning on the second pair using the second emission-control signal.

14. The method of claim 12, wherein providing multiple emission-control signals to respectively turn on the multiple pairs of emission-control transistors comprises using each individual one of the multiple emission-control signals to:

turn on one of the multiple first emission-control transistors in a respective pair of the multiple pairs of emission-control transistors in at least one emission period of a respective one of the multiple portions of the one cycle time to control a voltage level of the source electrode of the driving transistor being set by a high voltage supply while turning off others of the multiple first emission-control transistors; and turn on one of the multiple second emission-control transistors in respective pair of the multiple pairs of emission-control transistors in the at least one emission period to allow a drive current to drive light emission of a respective one of the multiple light-emitting diodes in the respective one of the multiple rows of pixels in the column while turning off others of the multiple second emission-control transistors.

15. The method of claim 14, wherein gate electrodes of the multiple first emission-control transistors are respectively controlled by different ones of the multiple emission-control signals;

gate electrodes of the multiple second emission-control transistors are respectively controlled by different ones of the multiple emission-control signals; and gate electrodes of the one of the multiple first emission-control transistors and the one of the multiple second emission-control transistors in a same pair of the multiple pairs of emission-control transistors are controlled by a same one of the multiple emission-control signals.

16. The method of claim 14, further comprising:

applying a turn-off voltage to gate electrodes of the one of the multiple first emission-control transistors and the one of the multiple second emission-control transistors in the respective pair of the multiple pairs of emission-control transistors during a reset period and a data input and compensation period following the reset period in a respective one of the multiple portions of the one cycle time; and applying a turn-on voltage to two gate electrodes of the one of the multiple first emission-control transistors and the one of the multiple second emission-control transistors in a respective pair of the multiple pairs of emission-control transistors during the emission period following the data input and compensation period.

17. The method of claim 11, further comprising dividing one cycle time of displaying one frame of image into the multiple portions by setting a clock signal generator for generating a same number of multiple emission-control signals in the one cycle time, wherein each portion includes sequentially a reset period, data input and compensation period, and an emission/non-emission period;

applying a reset signal at a turn-on voltage to a gate electrode of the reset transistor during the reset period and at a turn-off voltage during remaining periods in each of the multiple portions of the one cycle time;

applying a gate-driving signal at a turn-on voltage to gate electrodes of the data-input transistor and the drive-control transistor during the data input and compensation period and at a turn-off voltage during remaining periods in the each of the multiple portions of the one cycle time; and applying a data signal to a data line in the data input and compensation period in the each of the multiple portions of the one cycle time.

18. The method of claim 17, further comprising:

applying one emission-control signal at a turn-on voltage to one gate electrode of only one of the multiple first emission-control transistors and another gate electrode of only one of the multiple second emission-control transistors while applying other emission-control signals at a turn-off voltage to other gate electrodes of remaining ones of the multiple first emission-control transistors and remaining ones of the multiple second emission-control transistors during the emission/non-emission period in each of the multiple portions of the one cycle time, wherein the emission/non-emission period has a start point slightly delayed from an end point of the data input and compensation period of the each of the multiple portions of the one cycle time.

* * * * *